US011096253B1

(12) United States Patent
Mays, II et al.

(10) Patent No.: US 11,096,253 B1
(45) Date of Patent: Aug. 17, 2021

(54) METHOD AND CIRCUITRY TO CONFIGURE MULTIPLE DRIVERS SIMULTANEOUSLY

(71) Applicant: Universal Lighting Technologies, Inc., Madison, AL (US)

(72) Inventors: Stephen D. Mays, II, Madison, AL (US); John J. Dernovsek, Madison, AL (US); Scott Price, Madison, AL (US); Dane Sutherland, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 601 days.

(21) Appl. No.: 16/027,676

(22) Filed: Jul. 5, 2018

Related U.S. Application Data

(60) Provisional application No. 62/528,775, filed on Jul. 5, 2017.

(51) Int. Cl.

| | |
|---|---|
| ***H05B 45/30*** | (2020.01) |
| ***H05B 45/37*** | (2020.01) |
| ***H05B 45/10*** | (2020.01) |
| ***H05B 47/105*** | (2020.01) |
| ***H01F 38/14*** | (2006.01) |
| ***H05B 47/19*** | (2020.01) |

(52) U.S. Cl.
CPC ..... *H05B 45/10* (2020.01); *H01F 38/14* (2013.01); *H05B 45/30* (2020.01); *H05B 45/37* (2020.01); *H05B 47/105* (2020.01); *H05B 47/19* (2020.01)

(58) Field of Classification Search
CPC ..... H05B 45/10; H05B 45/30; H05B 45/37; H05B 45/3725; H05B 45/385; H05B 47/105; H05B 47/18; H05B 47/185; H02M 1/08; H02M 3/156; H02M 3/335
See application file for complete search history.

(56) References Cited

U.S. PATENT DOCUMENTS

| | | | |
|---|---|---|---|
| 6,144,539 | A | 11/2000 | Konopka et al. |
| 6,204,613 | B1 | 3/2001 | Hesterman |
| 6,356,027 | B1 | 3/2002 | Zhang et al. |
| 7,333,353 | B2 | 2/2008 | Yin |

(Continued)

FOREIGN PATENT DOCUMENTS

| | | | |
|---|---|---|---|
| EP | 2306791 | A2 | 4/2011 |
| WO | 2014013377 | A2 | 1/2014 |

*Primary Examiner* — Thai Pham
(74) *Attorney, Agent, or Firm* — Patterson Intellectual Property Law, P.C.; Gary L. Montle; Grant M. Ford

(57) ABSTRACT

Multi-driver configuration apparatuses, systems, and methods are provided. Apparatuses, systems, and methods are provided for multi-driver configuration of a plurality of light emitting diode (LED) drivers. The system includes a plurality of LED drivers having a transformer, an input interface coupleable to the configuration device via a common communication medium, a microcontroller, a direct current (DC) sensing section to detect at least a portion of a tuning signal received at the input interface and to transmit a driver control input signal corresponding to the at least a portion of the tuning signal to the microcontroller, and a transmit switch configured to receive a driver control output signal from the microcontroller and to cause at least one output signal to be output from the LED driver via the input interface. A configuration device transmits the tuning signal to at least one LED driver.

26 Claims, 6 Drawing Sheets

(56) References Cited

U.S. PATENT DOCUMENTS

| | | | | |
|---|---|---|---|---|
| 7,750,577 | B2 | 7/2010 | Nerone et al. | |
| 8,654,485 | B1 * | 2/2014 | Koehler | H05B 47/175 361/18 |
| 9,565,744 | B2 | 2/2017 | Lai et al. | |
| 9,681,512 | B1 | 6/2017 | Xiong et al. | |
| 9,913,354 | B1 * | 3/2018 | Yang | H05B 47/19 |
| 10,285,231 | B2 * | 5/2019 | Schonberger | H05B 45/10 |
| 2010/0102747 | A1 | 4/2010 | Ilyes et al. | |
| 2010/0181935 | A1 | 7/2010 | Wu | |
| 2012/0262432 | A1 * | 10/2012 | Kamata | H05B 45/60 345/204 |
| 2015/0054423 | A1 | 2/2015 | Tyson et al. | |
| 2016/0204700 | A1 * | 7/2016 | Mayer | H02M 3/156 315/224 |
| 2018/0018866 | A1 * | 1/2018 | Carlin | G08B 29/043 |

* cited by examiner

300

400

500

METHOD AND CIRCUITRY TO CONFIGURE MULTIPLE DRIVERS SIMULTANEOUSLY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of U.S. Provisional Patent Application No. 62/528,775, dated Jul. 5, 2017, entitled "Method and Circuitry to Configure Multi Drivers Simultaneously," and which is hereby incorporated by reference in its entirety.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to apparatuses, systems, and methods for simultaneously configuring multiple drivers, such as light emitting diode (LED) drivers.

Many luminaire manufacturers desire to configure LED drivers before shipping to customers for installation without being coupled to a mains power source. An exemplary system for providing driver tuning is provided by U.S. Pat. No. 8,654,485. Referring first to FIG. 1, an embodiment of an interface circuit 10 in accordance with the U.S. Pat. No. 8,654,485 includes first and second input terminals 12, 14 across which an input voltage may be received from an external source. A protection circuit 16 is coupled to the first and second input terminals 12, 14, and may generally be effective to allow an input voltage to be supplied to the remainder of the interface circuit 10 when the input voltage is within a predetermined acceptable input range (e.g., 0 to 10 Vdc), and further effective to prevent the input voltage from being supplied to the remainder of the interface circuit 10 when the input voltage is outside of the predetermined range (e.g., a line voltage having been inadvertently applied to the input terminals, for example of about 347 Vac).

A first current source circuit 18 is coupled to the protection circuit 16. In the first current source circuit 18 may be configured to provide a fixed current output and further provide a fixed voltage offset with respect to the received voltage input.

An isolation circuit 26 is coupled to the first current source circuit 18 and is effective to provide galvanic isolation between the first current source circuit 18 and an output stage of the interface circuit 10. The isolation circuit 26 includes a transformer 20 having a first winding 20a coupled to the first current source circuit 18.

A second current source circuit 28 is coupled to a second winding 20b of the transformer 20 of the isolation circuit 26. The second current source circuit 28 may cancel out the fixed voltage offset provided by the first current source circuit 18, resulting in an output voltage (Vout) being provided by the second current source circuit 28 which linearly tracks the input voltage (Vin) applied across the input terminals 12, 14.

A drive circuit 24 is coupled to a third winding 20c of the transformer 20 of the isolation circuit 26. The drive circuit 24 may, in response to external drive signals, provide a limited amount of power to components of the first current source circuit 18 and reflect the input voltage and the fixed voltage offset added by the first current source circuit 18 to the second current source circuit 28.

In various embodiments, the drive circuit 24 includes a first switching element Q1 that, with the third winding 20c of the transformer 20, defines an input drive stage of a flyback converter circuit 26 as the isolation circuit 26. The switching element Q1 may be, for example, a MOSFET which is opened and closed via a square wave drive signal provided to its gate, with its source coupled to ground and its drain coupled to the third winding 20c. The second current source circuit 28 may include a diode D2 and capacitor C1 coupled to the second winding 20b of the transformer 20 which collectively define an output stage 22 of the flyback converter circuit 26, providing the voltage to the second current source circuit 28 which reflects the input voltage and the fixed voltage offset added by the first current source circuit 18.

Alternatively stated, in such embodiments a flyback converter circuit 26 is defined by the switching element Q1, the various windings 20a, 20b, 20c of the isolation transformer 20, and an output stage 22 including output circuitry D2, C1, with the first current source circuit 18 coupled to the flyback converter circuit 26 via the first winding 20a and the second current source circuit 28 coupled to the flyback converter circuit via the output circuitry D2, C1.

In various embodiments communications circuitry 30 may be coupled to the second current source circuit 28 for sending and receiving data signals Rx, Tx via the interface circuit 10 and across the input terminals 12, 14. The interface circuit 10 may in such embodiments be effective thereby to operate as a data port for configuring an electronic ballast as is known in the art.

The communications circuitry 30 may include a second switching element Q2 such as, for example, a MOSFET having a gate coupled to a Tx data communications source, a source coupled to ground, and a drain coupled to a node between the output stage/output circuitry 22 of the flyback converter 26 and the second current source circuit 28. A node as represented between resistors R7, R9 in FIG. 1 may provide the output voltage Vout with respect to ground and further provide an Rx data communications node, wherein no additional communications circuitry is required.

The protection circuit 16 may include a diode D6 having its cathode coupled to the first input terminal 12 (+) and its anode coupled to the first current source circuit 18 to provide protection against the application of line voltages in one half cycle. The protection circuit 16 may further include a resistive network as represented by resistors R6, R8, R10, R11, R12, R13 coupled between the second input terminal 14 (−) and the first current source circuit 18 to provide protection against the application of line voltages for the other half cycle. The resistive network in an embodiment as shown may collectively provide sufficient impedance as to result in, for example, 2 W when 347 Vac is provided across the input terminals 12, 14. These figures are however merely exemplary and various alternative component configurations and values may further be anticipated to protect against the application of line voltages for both half-cycles within the scope of the present invention.

The first current source circuit 18 includes an integrated circuit U2 which operates as a low temperature coefficient (temperature compensated) shunt regulator and in combination with associated circuitry is effective to provide a fixed current (e.g., 200 uA) and a fixed voltage offset (e.g., 8.53 Vdc) on top of the input DC voltage Vin. A current source integrated circuit U2 may be a programmable three-pin shunt regulator diode TL431 as manufactured by Texas Instruments, and the technical data for which is incorporated herein by reference.

The second current source circuit 28 includes an integrated circuit U1 having equivalent properties (e.g., the aforementioned TL431 integrated circuit) which in combination with associated circuitry is effective to cancel out the fixed voltage offset provided by the first current source circuit 18, resulting in an output voltage Vout which linearly tracks the input DC voltage Vin substantially independent of the temperature. Additional features of related art systems may be found in U.S. Pat. No. 8,654,485, which is incorporated by reference herein in its entirety.

Although the U.S. Pat. No. 8,654,485 system permits driver configuration, the circuit of FIG. 1 requires application of mains power to operate, and the interface does not allow a plurality of drivers to be provided in a parallel configuration with other drivers having a like interface to support multiple driver configuration.

Another example of a method that is suited for configuring an individual unpowered driver is found in U.S. Pat. No. 9,565,744. In this patent, Near Field Communication (NFC) technology is used to place configuration settings in a driver whether or not mains power is applied. This technology requires a wireless connection to an antenna that is made available via the housing so long as the housing is exposed. The metal structure of most of the luminaires in which this product would be installed will shunt the fields from the configuration device disabling this interface. Furthermore, this interface is not designed to be bussed, and therefore can only support configuration of one driver at a time.

An example of an interface that allows multiple, powered driver configuration is the digital addressable lighting interface (DALI). The DALI interface is by design a bussed interface, and, by specification, can therefore be used to configure up to 64 drivers simultaneously. This DALI interface when fully built up can power the bus and the first stage of receiver components. By specification, it can deliver up to 2 mA to power a low power microcontroller, but in typical applications the available 2 mA is used to power the local DALI receiver circuitry. This interface is not suitable for multiple, unpowered driver configuration.

BRIEF SUMMARY OF THE INVENTION

It is thus desirable to provide simultaneous configuration of multiple, unpowered, light emitting diode (LED) drivers to meet customer demands. In a scenario where multiple drivers are installed in a single luminaire, it is sometimes desirable to be able to configure all or some of the installed drivers simultaneously without having to separate one driver from the others or apply mains power to the drivers. In this scenario it is common to connect together in parallel all analog interface wires. One aspect of the present disclosure relates to providing apparatuses, systems, and methods for configuring multiple drivers simultaneously, without having to first apply mains power to the drivers.

Various solutions consistent with the present disclosure may be accomplished by connecting unpowered drivers to a configuration device that is capable of powering the microcontrollers of the connected drivers, performing two-way communication with the microcontrollers, and configuring the drivers. The configuration device may generate a substantially sinusoid carrier signal (e.g., at 460.8 kHz) that is modulated via ON-OFF keying to generate a Manchester-encoded serial bit pattern. The sinusoid carrier signal may be of sufficient amplitude and the source impedance is low enough to act as a constant alternating current (AC) source so as to power the microcontrollers.

A direct current (DC) blocking capacitor may be connected to an input terminal of the primary of an isolating and level-shifting transformer. Both terminals of the secondary winding of the transformer are connected to a full-bridge rectifier that feeds a hold-up capacitor and linear regulator through DC sensing circuitry and a series-connected diode. Between the full-bridge rectifier and the DC sensing circuitry is a terminal of a single switch that is terminated to circuit ground, the purpose of which is to short the constant AC from the configuration device.

One object of the systems and methods disclosed herein is to provide a light emitting diode (LED) driver providing an unpowered tuning interface coupleable to a configuration device which receives a common tuning signal transmitted from the configuration device to a plurality of LED drivers. The LED driver includes a transformer having a primary winding a secondary winding and an input interface having a first terminal and a second terminal coupled to the primary winding, the input interface coupleable to the configuration device. The LED driver further includes a microcontroller. A direct current (DC) sensing section is coupled to the secondary winding and is configured to detect at least a portion of a tuning signal received at the input interface and to transmit a driver control input signal corresponding to the at least a portion of the tuning signal to the microcontroller. A transmit switch is coupled to the microcontroller and to the secondary winding, the transmit switch configured to receive a driver control output signal from the microcontroller and to cause at least one output signal to be output from the LED driver via the input interface.

The LED driver may receive operating power during an unpowered tuning operation via the input interface, and the microcontroller may perform at least one tuning operation corresponding to the unpowered tuning signal.

The input interface may receive both an analog dimming control signal and the tuning signal, the microcontroller being configured to perform at least one operation associated with at least one of the analog dimming control signal and the tuning signal.

The microcontroller may obtain operational power from the tuning signal as a constant alternating current (AC) source. The tuning signal may be a sinusoidal carrier signal acting as the constant AC source for powering the microcontroller. The sinusoidal carrier signal may be a 460.8 kHz substantially sinusoidal carrier signal which is modulated via ON-OFF keying and comprises a Manchester-encoded serial bit pattern.

The LED driver may include a blocking diode having a cathode and an anode, the blocking diode coupled to the DC sensing section at the anode, and a voltage regulator having an input side and an output side, the voltage regulator coupled between the cathode of the blocking diode and the microcontroller.

The LED driver may include (1) an input capacitor having a first side and a second side, the first side of the input capacitor coupled between the cathode of the blocking diode and the input side of the voltage regulator, and the second side of the input capacitor coupled to ground, and (2) an output capacitor having a first side and a second side, the first side of the output capacitor coupled between the output side of the voltage regulator and the microcontroller, and the second side of the output capacitor coupled to ground. The blocking diode may prevent the input capacitor and the output capacitor from being discharged by the transmit switch. The transmit switch may shunt current from the voltage regulator and the microcontroller.

The transmit switch may transmit a reply signal corresponding to the received tuning signal.

A further aspect relates to providing a method for providing simultaneous configuration of LED drivers. The method begins by receiving an input signal at an input interface of the LED driver. At least a portion of a tuning signal within the input signal received at the input interface may be detected. A driver control input signal corresponding to the at least a portion of the tuning signal to a microcontroller of the LED driver may be transmitted. At least one tuning operation may be performed based at least in part upon the driver control input signal.

A driver control output signal from the LED driver may be transmitted responsive to the driver control input signal.

Transmitting the driver control output signal may include (1) generating the driver control output signal by the microcontroller based at least in part upon the driver control input signal, (2) transmitting the driver control output signal to a transmit switch of the LED driver, and (3) outputting a representation of the driver control output signal by controlling an operating status of the transmit switch according to the driver control output signal.

The LED driver may be powered in a tuning mode via the input interface which received the input signal.

Input interfaces of a plurality of LED drivers may be coupled to a common communication medium, and at least a portion of the plurality of LED drivers may be group tuned via one or more common tuning signals received via the common communication medium.

Two-way communications between a configuration device and the LED driver may be enabled via the input interface and a transmit switch coupled to the input interface while also providing operating power for the LED driver via the input interface.

A further aspect includes a system for providing multi-driver configuration for a plurality of LED drivers. The system includes a plurality of LED drivers. Each LED driver includes (1) a transformer having a primary winding a secondary winding, (2) an input interface having a first terminal and a second terminal coupled to the primary winding, the input interface coupleable to the configuration device via a common communication medium, (3) a microcontroller, (4) a direct current (DC) sensing section coupled to the secondary winding and configured to detect at least a portion of a tuning signal received at the input interface and to transmit a driver control input signal corresponding to the at least a portion of the tuning signal to the microcontroller, and (5) a transmit switch coupled to the microcontroller and to the secondary winding, the transmit switch configured to receive a driver control output signal from the microcontroller and to cause at least one output signal to be output from the LED driver via the input interface. The system further includes a configuration device coupleable to the input interface of at least one of the plurality of LED drivers, the configuration device configured to transmit the tuning signal via the input interface of the at least one of the plurality of LED drivers.

The LED driver may receive operating power during an unpowered tuning operation from the configuration device via the input interface, and the microcontroller may perform at least one tuning operation corresponding to the unpowered tuning signal.

The input interface may receive both an analog dimming control signal and the tuning signal from the configuration device, and the microcontroller may perform at least one operation associated with at least one of the analog dimming control signal and the tuning signal.

The microcontroller may obtain operational power from the tuning signal as a constant alternating current (AC) source. The tuning signal may include a sinusoidal carrier signal acting as the constant AC source for powering the microcontroller. The sinusoidal carrier signal may include a 460.8 kHz substantially sinusoidal carrier signal which is modulated via ON-OFF keying and comprises a Manchester-encoded serial bit pattern.

The input interface may include a common interface configured to receive one or more tuning signals from the configuration device and one or more dimming control signals from a dimming controller.

The transmit switch may transmit a reply signal to the configuration device, the reply signal corresponding to the received tuning signal.

The configuration device may simultaneously configure two or more of the plurality of LED drivers using a same tuning control signal transmitted from the configuration device as a single tuning signal provided to the common communication medium, the same tuning control signal received by the two or more of the plurality of LED drivers via each LED driver's input interface.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
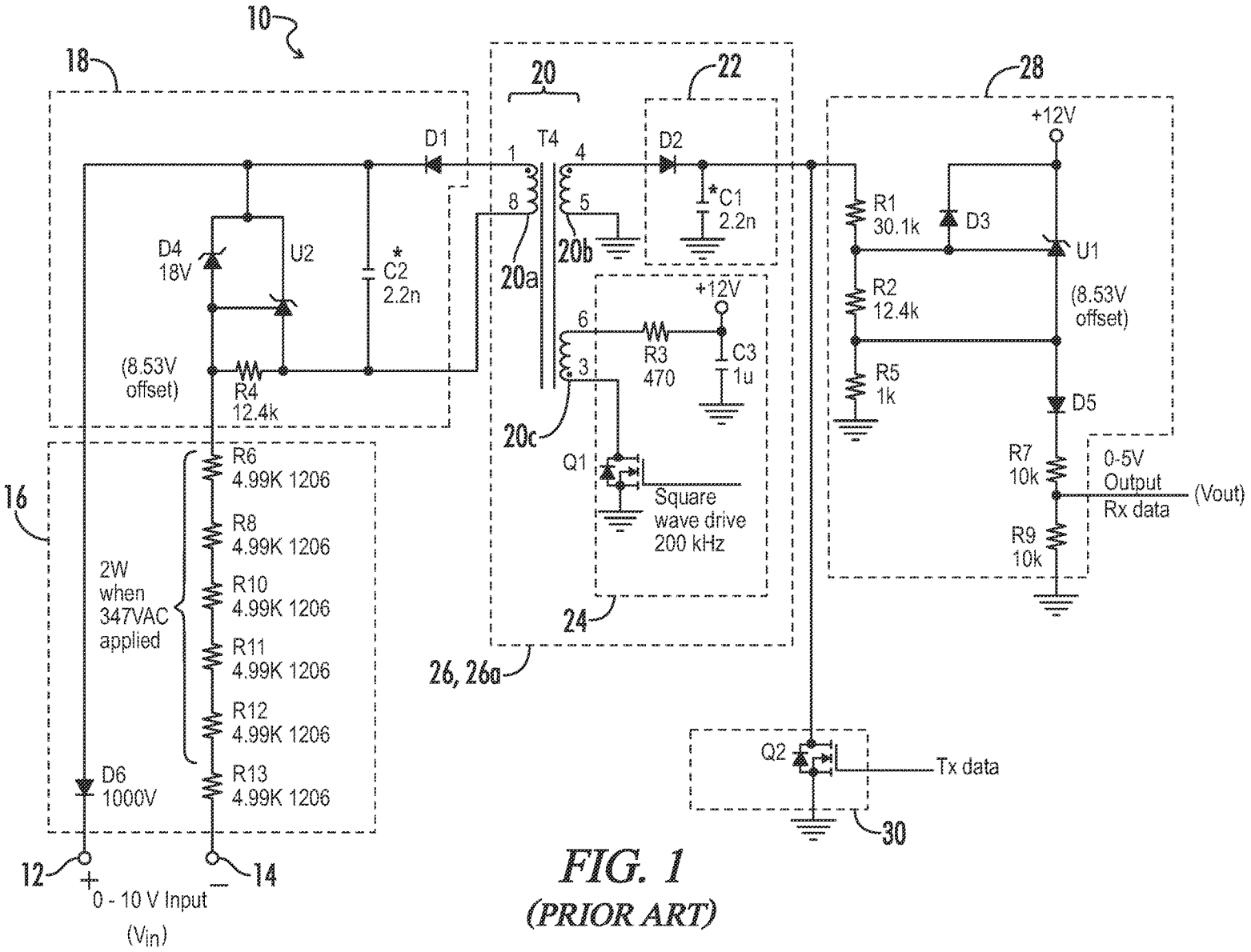
FIG. 1 (PRIOR ART)
FIG. 1 illustrates a circuit schematic of a related art single driver configuration system.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-7, an exemplary apparatuses, systems, and methods for configuring multiple light emitting diode (LED) drivers are provided. Where the various figures may describe embodiments sharing various common elements and features with other embodiments, similar elements and features are given the same reference numerals and redundant description thereof may be omitted below.

Figure 2:
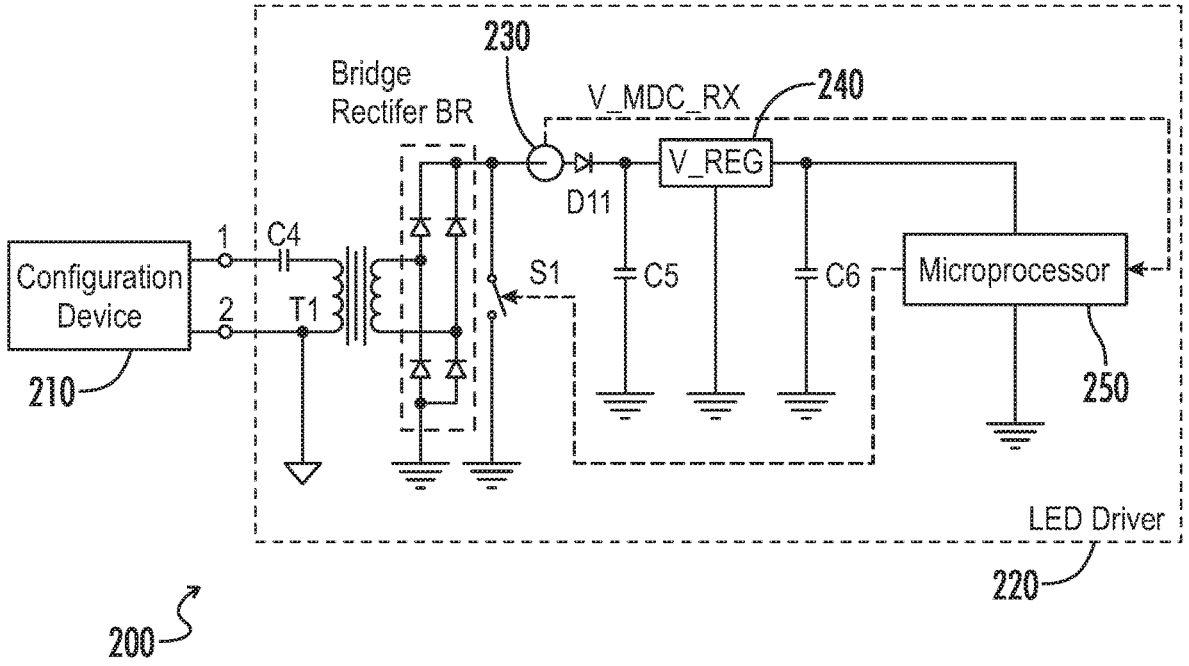
FIG. 2 illustrates a partial functional block diagram of a configuration circuit according to an exemplary embodiment.

FIG. 2 illustrates a partial functional block diagram of a configuration circuit 200 according to an exemplary embodiment. The configuration circuit 200 includes a configuration device 210 and a light emitting diode (LED) driver 220. The LED driver 220 includes a first terminal 1, a second terminal 2, a capacitor C4, a transformer T1, a bridge rectifier BR, a transmit switch S1, a blocking diode D11, an input capacitor C5, a voltage regulator 240, an output capacitor C6, and a microcontroller 250.

The configuration device 210 may be electronically coupleable to the LED driver 220 using at least one of the first terminal 1 and the second terminal 2. The first terminal 1 and the second terminal 2 may be associated with low voltage dimming wires for providing 0-10V dimming control. In one exemplary embodiment, the first terminal 1 may be a part of or otherwise coupled to a violet wire (e.g., associated with a +10V signal) and the second terminal 2 may be a part of or otherwise coupled to a gray wire (e.g., associated with a signal common).

The configuration device 210 may be configured to transmit at least a portion of a configuration signal when coupled to the LED driver 220. The configuration signal may include at least a portion of a multi-driver configuration (MDC) signal in various embodiments. The MDC signal may be a carrier signal. In one exemplary embodiment, the MDC signal is a substantially sinusoidal signal at 460.8 kHz having an associated relatively low output impedance from the configuration device 210 and across the low voltage dimming control wires (e.g., across the first terminal 1 and the second terminal 2). Although described with reference to a frequency of 460.8 kHz, any predetermined or dynamically determined carrier frequency may be implemented without departing from the spirit and the scope of the present disclosure.

The capacitor C4 may be coupled between the first terminal 1 and the transformer T1. The capacitor C4 may be a direct current (DC) blocking capacitor configured to block a DC component of a signal received from the configuration device 210 in one exemplary embodiment. The capacitor C4 may be configured to provide a low impedance to the configuration signal (e.g., the MDC signal). The transformer T1 may be an isolating transformer having a primary side winding at a side coupleable to the configuration device 210 and having a secondary side winding at a side coupleable to one or more components of the LED driver 220.

The transformer T1 may be configured to couple the AC carrier signal (e.g., MDC signal) to a bridge rectifier BR of the LED driver 220. The bridge rectifier BR may include rectifying diodes D7, D8, D9, and D10 may be coupled to the secondary side of the transformer T1. An output of the bridge rectifier BR may be coupled to ground via the transmit switch S1.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa. The transmit switch S1 may be implemented in various embodiments using any three terminal semi-conductor switch, such as a BJT or a MOSFET (e.g., Triac, IGBT, semi-conductor relay, or the like), although additional variations of the transmit switch S1 may be implemented without departing from the spirit and scope of the present disclosure. In one exemplary embodiment, the transmit switch S1 is a MOSFET.

An output of the bridge rectifier BR may be coupled to component(s) 230. Although not illustrated, the component(s) 230 may include one or more circuit elements configured to perform one or more operations of the LED driver 220. In various exemplary embodiments, the component(s) 230 comprise a direct current (DC) sensing section configured to sense a DC component associated with a signal received by the LED driver 220. In one exemplary embodiment, the component(s) 230 includes no components or includes a single conductive bus to couple the bridge rectifier BR to one or more elements of the LED driver 220. The component(s) 230 may be further coupled to an anode of the blocking diode D11. In various embodiments, the component(s) 230 are configured as a current measurement network (e.g., a direct current (DC) sensing section) configured to detect at least a portion of a signal received at the LED driver 220. Detected signals may include, for example one or more carrier waves received from the configuration device 210. At least a portion of the component(s) 230 may be housed within the LED driver 220, external to the LED driver 220, or any combination thereof.

The cathode of the blocking diode D11 may be coupled to the input capacitor C5 and to the voltage regulator 240. An output of the voltage regulator 240 may be coupled to the output capacitor C6 and to the microcontroller 250. The microcontroller may be any processing element implementable in at least one of hardware, software, or a combination thereof. In one exemplary embodiment, the microcontroller 250 is a physical microprocessor programmed to perform one or more operations, either in whole or in part. Additionally or alternatively, one or more operations of the microcontroller 250 may be performed either locally at the LED driver 220, externally to the LED driver 220 (e.g., in a distributed or cloud-based computing environment), or any combination thereof. The microcontroller 250 may be configured to receive both the driver control input signal V_MDC_RX from the component(s) 230 and an output of the voltage regulator 240 as input and to output a switch transmit signal S_MDC_TX configured to control the transmit switch S1. The driver control input signal V_MDC_RX received from the component(s) 230 may correspond to an input signal received from the configuration device 210.

The transmit switch S1 is configured to transmit one or more signals from the LED driver 220 to the configuration device 210. The microcontroller 250 of the LED driver 220 is configured to control the transmit switch S1 to develop marks and spaces which may be detectable by the configuration device 210. The transmit switch S1 is configured to shunt current from the voltage regulator 240 and the microcontroller 250. The blocking diode D11 may be configured to prevent the input capacitor C5 and the output capacitor C6 from being discharged by the transmit switch S1. The spaces created by the transmit switch S1 may be detected by the configuration device 210 and may be accumulated into either portions packets of data or entire packets of data representing replies from the LED driver 220. An exemplary representation of serial data transmitted to the configuration device 210 from the LED driver 220 is illustrated by, and described below with reference to, FIG. 5. The configuration device 210 and the microcontroller 250 may thus be configured to implement two-way communications therebetween.

Figure 3:
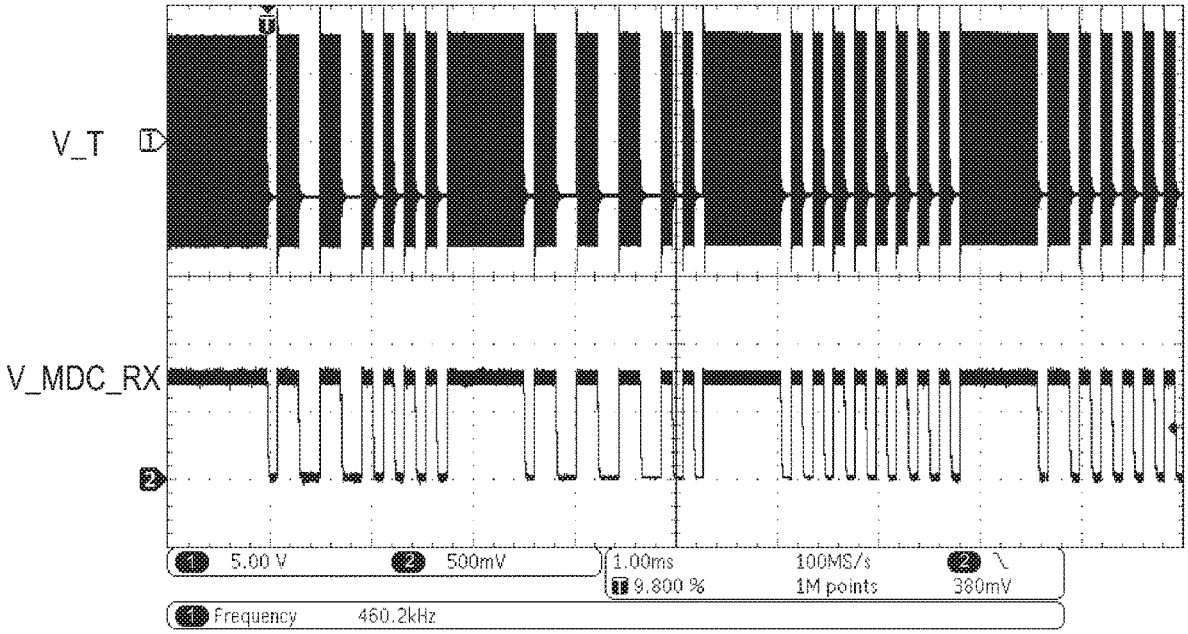
FIG. 3 illustrates a timing diagram of serial data transmitted from a configuration device to an LED driver according to an exemplary embodiment.

FIG. 3 illustrates a timing diagram of serial data transmitted from a configuration device to an LED driver according to an exemplary embodiment. The configuration device serial data transmission diagram 300 illustrates a plot of a terminal voltage V_T across terminal 1 and terminal 2 and the driver control input signal V_MDC_RX over a common time reference. When the configuration device 210 transmits a carrier signal to the LED driver 220 via the terminals 1 and 2, the components 230 may be configured to operate as a current measurement network (e.g., a DC sensing section) to generate the driver control input signal V_MDC_RX. The driver control input signal V_MDC_RX may be provided to the microcontroller 250. The microcontroller 250 may use the driver control input signal V_MDC_RX to control one or more operations of the transmit switch S1 (e.g., to convey one or more signals from the LED driver 220 to the configuration device 210).

As illustrated in FIG. 3, when a carrier signal is not received via the terminals 1 and 2, the driver control input signal V_MDC_RX is substantially zero. In contrast, when a carrier signal is transmitted from the configuration device 210 to the LED driver 220, the value of the driver control input signal V_MDC_RX provided to the microcontroller 250 may correspond (e.g., rise or fall) to an appropriate logic level value. The configuration device 210 may be configured to generate the carrier signal, for example by modulating the carrier signal in an ON-OFF keying manner to send a serial stream of data from the configuration device 210 to the microcontroller 250. The ON-OFF keying modulation of the carrier signal may be detected to the component(s) 230 and output to the microcontroller 250 as the driver control input signal V_MDC_RX. The microcontroller 250 is configured to receive and process the driver control input signal V_MDC_RX (e.g., by accumulating and interpreting the driver control input signal V_MDC_RX as serial data to determine one or more received queries and/or commands).

Figure 4:
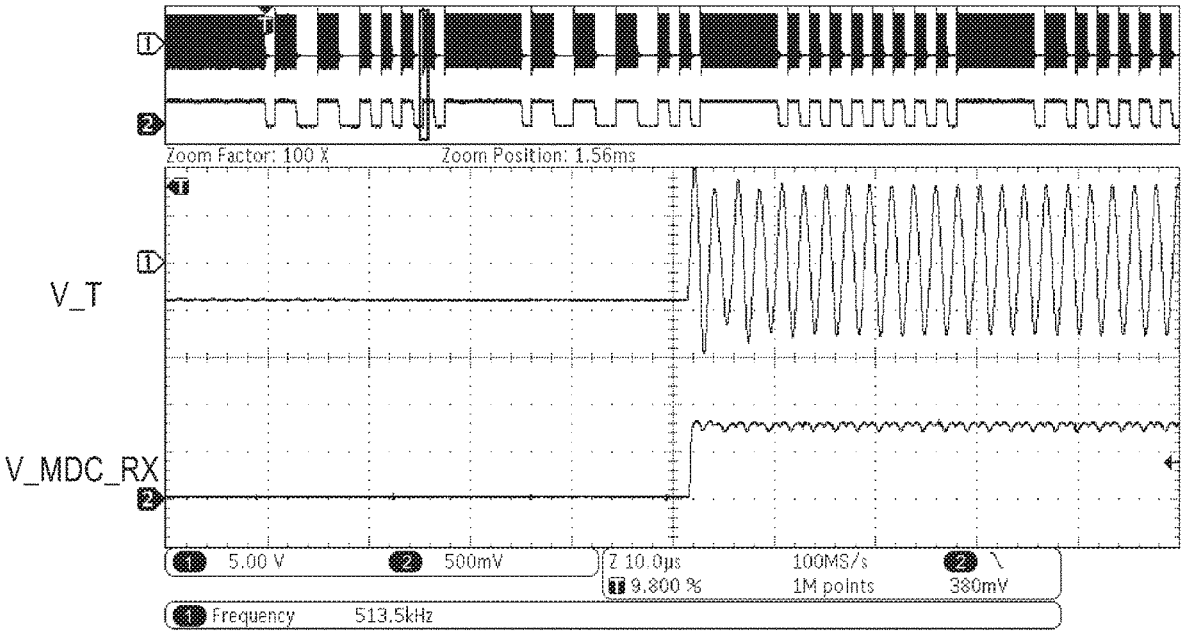
FIG. 4 illustrates a reduced time scale of the timing diagram of serial data transmitted from a configuration device to an LED driver according to the exemplary embodiment of FIG. 3.

FIG. 4 illustrates a reduced time scale of the timing diagram of serial data transmitted from a configuration device to an LED driver according to the exemplary embodiment of FIG. 3. The reduced time scale configuration device serial data transmission diagram 400 illustrates a plot of the terminal voltage V_T across terminal 1 and terminal 2 and the driver control input signal V_MDC_RX over a common time reference. In the exemplary embodiment of FIG. 4, the terminal voltage V_T reflects a substantially sinusoidal AC input signal received across the terminals 1 and 2 from the configuration device 210 at the LED driver 220.

The plot illustrated by FIG. 4 reflects a time-zoomed portion of the exemplary embodiment of FIG. 3. As illustrated by FIG. 4, when a carrier signal is received across the terminals 1 and 2, the component(s) 230 of the LED driver 220 may be configured to output a value of the driver control input signal V_MDC_RX. The driver control input signal V_MDC_RX or a representation thereof may be provided to the microcontroller 250 of the LED driver 220. When a substantially sinusoidal AC signal is received across the terminals 1 and 2, the component(s) 230 are configured to cause a logic level of the driver control input signal V_MDC_RX to be a predetermined or dynamically determined value.

Figure 5:
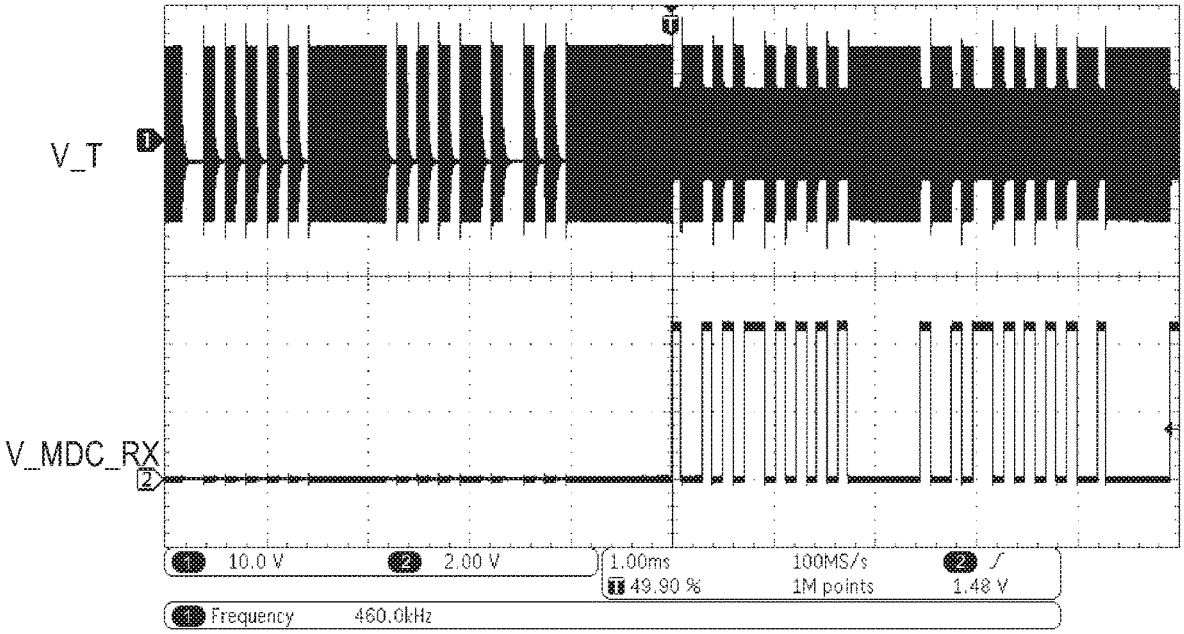
FIG. 5 illustrates a timing diagram of serial data transmitted from an LED driver to a configuration device according to an exemplary embodiment.

FIG. 5 illustrates a timing diagram of serial data transmitted from an LED driver to a configuration device according to an exemplary embodiment. The LED driver serial data transmission diagram 500 illustrates a plot of a terminal voltage V_T across terminal 1 and terminal 2 and the driver control output signal V_MDC_TX over a common time reference. The LED driver 220 is configured to transmit one or more signals to the configuration device 210 via the terminals 1 and 2. The microcontroller 250 is configured to generate the driver control output signal V_MDC_TX. In various embodiments, the driver control output signal V_MDC_TX may be generated, in whole or in part, based on at least one V_MDC_RX signal received at the microcontroller 250 (e.g., as a response or control signal). Additionally or alternatively, the V_MDC_TX signal may be generated by the microcontroller agnostic of the driver control input signals V_MDC_RX.

The microcontroller 250 may be communicatively coupled to the transmit switch S1. The driver control output signal V_MDC_TX may be used to control one or more operations of the transmit switch S1. To convey one or more signals to the configuration device 210, the microcontroller 250 in one exemplary embodiment develops marks and spaces detectable by the configuration device by controlling operation of the transmit switch, and thus the voltage across the terminals 1 and 2 (voltage V_T). The transmit switch S1 is configured to shunt current from the voltage regulator 240 and the microcontroller 250, but the blocking diode D11 may be configured to prevent the input capacitor C5 and the output capacitor C6 from being discharged by the transmit switch S1. The spaces created by the transmit switch S1 are detectable by the configuration device 210 and may be accumulated into entire packets of data representing communication(s) from the LED driver 220 (or a portion thereof). The communication(s) from the LED driver 220 may include one or more replies to a signal transmitted from the configuration device 210 to the LED driver 220.

Figure 6:
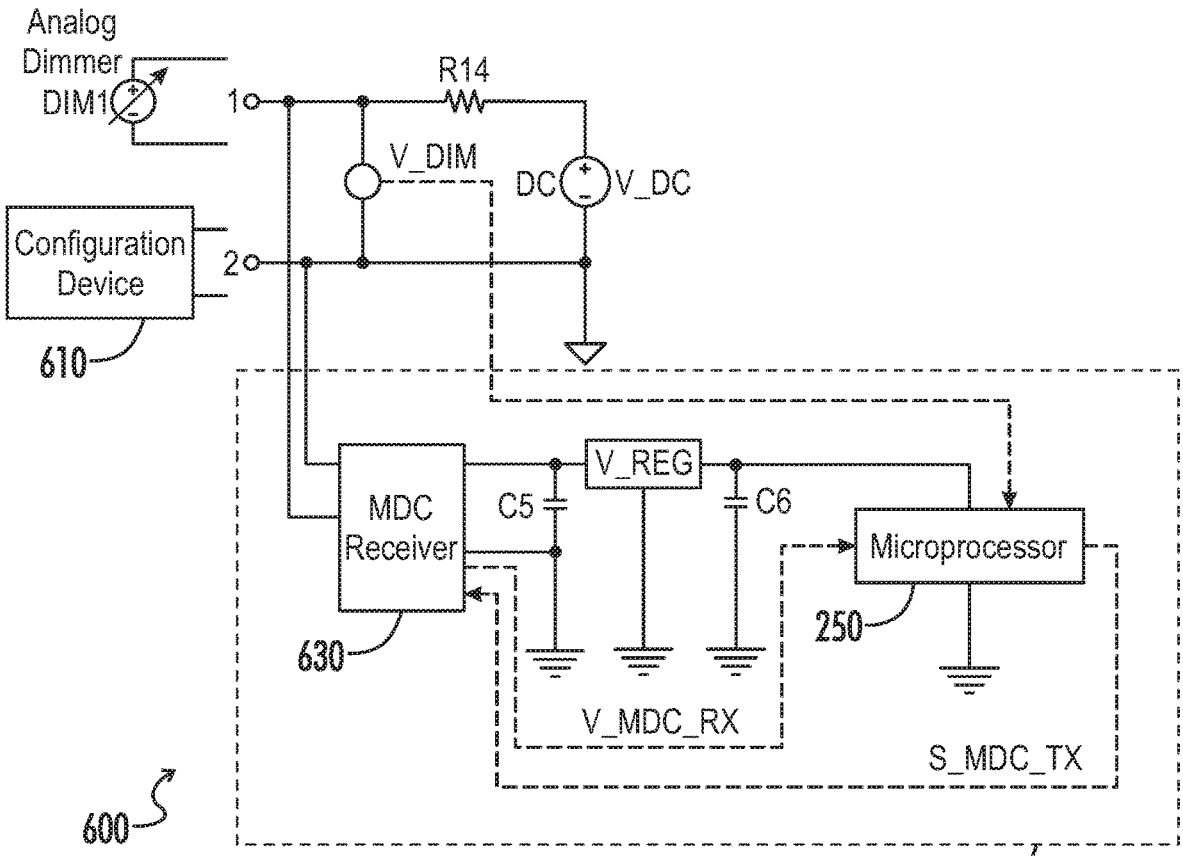
FIG. 6 illustrates a partial circuit schematic of a receiver configuration according to an exemplary embodiment.

FIG. 6 illustrates a partial circuit schematic of a receiver configuration according to an exemplary embodiment. The receiver configuration illustrated by FIG. 6 reflects a voltage-limited, constant DC analog interface. Under typical operating conditions where mains power is applied to an input of the LED driver 620, the analog dimming interface may be powered, and where a configuration device is not connected to terminals 1 and 2, the blocking capacitor C4 may block DC from the analog interface from flowing into the MDC receiver section. Accordingly, the MDC receiver section 630 may be configured in such a way as not to affect operation of the analog dimming interface.

The system 600 includes terminals 1 and 2 configured to couple to at least one of an analog dimmer DIM1 and/or a configuration device 610. The configuration device 610 may be a configuration device 210, as previously described herein. One or more LED drivers 620 may be coupled to the terminals 1 and 2. Each LED driver 620 may include an MDC receiver section 630. The MDC receiver section 630 may include one or more components of an LED driver as previously described with reference to LED driver 220. The MDC receiver section 630 may include one or more of the capacitor C4, the transformer T1, the bridge rectifier BR, the component(s) 230, and/or the transmit switch S1. Other components of the LED driver 220 may optionally be included within the MDC receiver section 630 without departing from the spirit and scope of the present disclosure.

The system 600 may include a voltage source V_DC coupled between the terminal 1 and the terminal 2. Although described with reference to DC voltage, it should be appreciated that the voltage source additionally or alternatively may include an AC power source. A dimming voltage V_DIM may be obtained across the terminals 1 and 2, which may be provided to at least one LED driver 620. A resistor R14 may be coupled between the terminal 1 and a terminal of the voltage source V_DC. A dimming voltage V_DIM may be measured across the terminals 1 and 2 and may be provided to at least one LED driver 620 (e.g., to a microcontroller 250 thereof).

Figure 7:
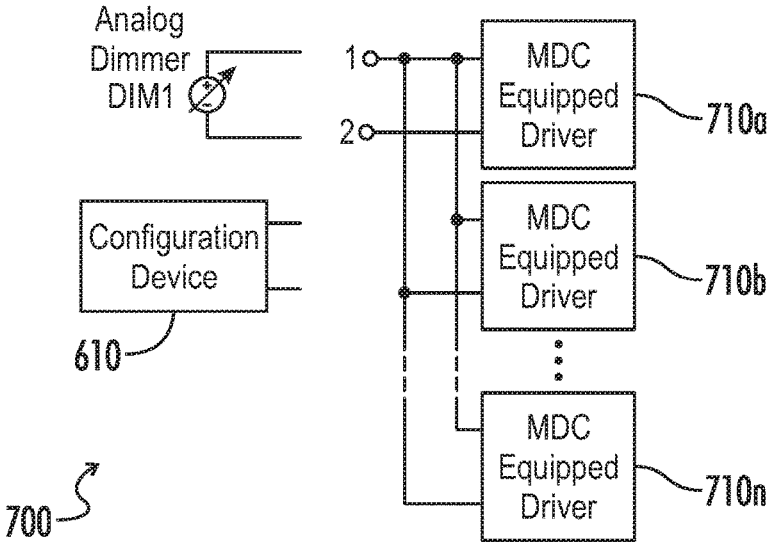
FIG. 7 illustrates a block diagram of a system having a plurality of MDC-equipped drivers coupled to a combined analog dimming and configuration interface.

FIG. 7 illustrates a block diagram of a system having a plurality of MDC-equipped drivers coupled to a combined analog dimming and configuration interface. In FIG. 7, a system 700 includes the analog dimmer DIM1 and the configuration device 610 may be coupleable to the terminals 1 and 2. At least one MDC-equipped LED driver 710*a*, 710*b*, . . . , 710*n* may be communicatively coupled to the terminals 1 and 2. One or more MDC-equipped LED driver 710*a*, 710*b*, . . . , 710*n* may be combined together in parallel to be controlled by one analog dimmer and/or configured by a configuration device 610. Because each MDC-equipped LED driver 710*a*, 710*b*, . . . , 710*n* includes communicative coupling to a same configuration device 610, the transmit switch S1 of any one of the MDC-equipped LED drivers 710*a*, 710*b*, . . . , 710*n* may be detected by the configuration device 610. As such, the configuration device 610 may be enabled to provide many-to-one, two-way communication between the configuration device 610 and one or more coupled MDC-equipped LED drivers 710*a*, 710*b*, . . . , 710*n*. The configuration device 610 may further provide modulated signaling to all or one connected device, thereby enabling one-to-many, two-way communication support.

Implementations consistent with the present disclosure enable multiple LED drivers to be configured simultaneously without the need to apply mains power. Implementations consistent with the present disclosure further provide the ability to share connection terminals/wires with an analog dimming interface without interfering with the operation of the analog dimming interface. A further advantage relates to allowing use of analog dimming interface wires to accept power and to support two-way communications. Another advantage of implementations consistent with the present disclosure relates to providing many-to-one and one-to-many two-way communication and power delivery using the same two wires as an analog dimming interface.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A light emitting diode (LED) driver providing an unpowered tuning interface coupleable to a configuration device and for receiving a shared tuning signal transmitted from the configuration device to a plurality of LED drivers, the LED driver comprising:

a transformer having a primary winding a secondary winding;

an input interface having a first terminal and a second terminal coupled to the primary winding, the input interface coupleable to the configuration device;

a microcontroller;

a direct current (DC) sensing section coupled to the secondary winding and configured to detect at least a portion of a tuning signal received at the input interface and to transmit a driver control input signal corresponding to the at least a portion of the tuning signal to the microcontroller; and a transmit switch coupled to the microcontroller and to the secondary winding, the transmit switch configured to receive a driver control output signal from the microcontroller and to cause at least one output signal to be output from the LED driver via the input interface.

2. The LED driver of claim 1, wherein the LED driver is configured to receive operating power during an unpowered tuning operation via the input interface, and wherein the microcontroller is configured to perform at least one tuning operation corresponding to the tuning signal.

3. The LED driver of claim 1, wherein the input interface is configured to receive both an analog dimming control signal and the tuning signal, the microcontroller configured to perform at least one operation associated with at least one of the analog dimming control signal and the tuning signal.

4. The LED driver of claim 1, wherein the microcontroller is configured to obtain operational power from the tuning signal as a constant alternating current (AC) source.

5. The LED driver of claim 4, wherein the tuning signal comprises a sinusoidal carrier signal acting as the constant AC source for powering the microcontroller.

6. The LED driver of claim 5, wherein the sinusoidal carrier signal comprises a 460.8 kHz substantially sinusoidal carrier signal which is modulated via ON-OFF keying and comprises a Manchester-encoded serial bit pattern.

7. The LED driver of claim 1, further comprising:

a blocking diode having a cathode and an anode, the blocking diode coupled to the DC sensing section at the anode;

a voltage regulator having an input side and an output side, the voltage regulator coupled between the cathode of the blocking diode and the microcontroller.

8. The LED driver of claim 7, further comprising:

an input capacitor having a first side and a second side, the first side of the input capacitor coupled between the cathode of the blocking diode and the input side of the voltage regulator, and the second side of the input capacitor coupled to ground; and an output capacitor having a first side and a second side, the first side of the output capacitor coupled between the output side of the voltage regulator and the microcontroller, and the second side of the output capacitor coupled to ground.

9. The LED driver of claim 8, wherein the blocking diode is configured to prevent the input capacitor and the output capacitor from being discharged by the transmit switch.

10. The LED driver of claim 7, wherein the transmit switch is configured to shunt current from the voltage regulator and the microcontroller.

11. The LED driver of claim 1, wherein the transmit switch is configured to transmit a reply signal corresponding to the tuning signal.

12. A method for providing simultaneous configuration of a light emitting diode (LED) driver of a plurality of LED drivers, comprising:

receiving an input signal at an input interface of the LED driver;

detecting at least a portion of a tuning signal within the input signal received at the input interface;

transmitting a driver control input signal corresponding to the at least a portion of the tuning signal to a microcontroller of the LED driver; and performing at least one tuning operation based at least in part upon the driver control input signal.

13. The method of claim 12, further comprising:

transmitting a driver control output signal from the LED driver responsive to the driver control input signal.

14. The method of claim 13, wherein the transmitting the driver control output signal comprises:

generating the driver control output signal by the microcontroller based at least in part upon the driver control input signal;

transmitting the driver control output signal to a transmit switch of the LED driver; and outputting a representation of the driver control output signal by controlling an operating status of the transmit switch according to the driver control output signal.

15. The method of claim 12, further comprising:

powering the LED driver in a tuning mode via the input interface which received the input signal.

16. The method of claim 12, further comprising:

coupling a plurality of input interfaces of the plurality of LED drivers to a common communication medium; and group tuning at least a portion of the plurality of LED drivers via one or more common tuning signals received via the common communication medium.

17. The method of claim 12, further comprising:

enabling two-way communications between a configuration device and the LED driver via the input interface and a transmit switch coupled to the input interface while also providing operating power for the LED driver via the input interface.

18. A system for providing multi-driver configuration for a plurality of light emitting diode (LED) drivers coupleable to a common communication medium, the system comprising:

each LED driver of the plurality of LED drivers including, a transformer having a primary winding a secondary winding;

an input interface having a first terminal and a second terminal coupled to the primary winding and coupleable to the common communication medium;

a microcontroller;

a direct current (DC) sensing section coupled to the secondary winding and configured to detect at least a portion of a tuning signal received at the input interface and to transmit a driver control input signal corresponding to the at least a portion of the tuning signal to the microcontroller; and a transmit switch coupled to the microcontroller and to the secondary winding, the transmit switch configured to receive a driver control output signal from the microcontroller and to cause at least one output signal to be output from the LED driver via the input interface; and a configuration device coupleable to the input interface of at least one of the plurality of LED drivers, the configuration device configured to transmit the tuning signal via the input interface of the at least one of the plurality of LED drivers, the configuration device coupleable to the common communication medium coupleable via the input interface.

19. The system of claim 18, wherein the LED driver is configured to receive operating power during an unpowered tuning operation from the configuration device via the input interface, and wherein the microcontroller is configured to perform at least one tuning operation corresponding to the tuning signal.

20. The system of claim 18, wherein the input interface is configured to receive both an analog dimming control signal and the tuning signal from the configuration device, the microcontroller configured to perform at least one operation associated with at least one of the analog dimming control signal and the tuning signal.

21. The system of claim 18, wherein the microcontroller is configured to obtain operational power from the tuning signal as a constant alternating current (AC) source.

22. The system of claim 21, wherein the tuning signal comprises a sinusoidal carrier signal acting as the constant AC source for powering the microcontroller.

23. The system of claim 22, wherein the sinusoidal carrier signal comprises a 460.8 kHz substantially sinusoidal carrier signal which is modulated via ON-OFF keying and comprises a Manchester-encoded serial bit pattern.

24. The system of claim 18, wherein the input interface comprises a common interface configured to receive one or more tuning signals from the configuration device and one or more dimming control signals from a dimming controller.

25. The system of claim 18, wherein the transmit switch is configured to transmit a reply signal to the configuration device, the reply signal corresponding to the received tuning signal.

26. The system of claim 18, wherein the configuration device is configured to simultaneously configure two or more of the plurality of LED drivers using a same tuning control signal transmitted from the configuration device as a single tuning signal provided to the common communication medium, the same tuning control signal received by the two or more of the plurality of LED drivers via each LED driver's input interface.

* * * * *